US007114363B2

(12) United States Patent
Jääskeläinen et al.

(10) Patent No.: US 7,114,363 B2
(45) Date of Patent: Oct. 3, 2006

(54) SHEETMETAL FORMING METHOD

(75) Inventors: Seppo Jääskeläinen, Joutseno (FI); Juha Varis, Lappeenranta (FI); Erkki Veijalainen, Lappeenranta (FI)

(73) Assignee: Metehe Oy, Jouiseno (FI)

( * ) Notice: Subject to any disclaimer, the term of this patent is extended or adjusted under 35 U.S.C. 154(b) by 0 days.

(21) Appl. No.: 10/503,961

(22) PCT Filed: Dec. 5, 2002

(86) PCT No.: PCT/FI02/00992

§ 371 (c)(1),
(2), (4) Date: Jan. 10, 2005

(87) PCT Pub. No.: WO03/068430

PCT Pub. Date: Aug. 21, 2003

(65) Prior Publication Data

US 2005/0115299 A1 Jun. 2, 2005

(30) Foreign Application Priority Data

Feb. 14, 2002 (FI) ..... 20020300

(51) Int. Cl.
*B21D 22/02* (2006.01)

(52) U.S. Cl. ..... 72/379.6

(58) Field of Classification Search ..... 72/297, 72/307, 350, 379.2, 379.6
See application file for complete search history.

(56) References Cited

U.S. PATENT DOCUMENTS 4,109,503 A * 8/1978 Francon et al. ..... 72/352
4,211,102 A * 7/1980 Hurvitz ..... 72/304
4,617,818 A * 10/1986 Fukuyori ..... 72/379.2

FOREIGN PATENT DOCUMENTS

| | | |
|---|---|---|
| FI | 2131/70 | 8/1970 |
| JP | 10-329212 | 12/1998 |
| JP | 11-197768 | 7/1999 |
| JP | 2000-15352 | 1/2000 |

* cited by examiner

*Primary Examiner*—Lowell A. Larson
(74) *Attorney, Agent, or Firm*—Merchant & Gould P.C.

(57) ABSTRACT

A forming method for producing wall and ceiling cladding sheets from sheetmetal, wherein embossed patterns are pressed into a metal sheet so that they cover the entire surface area of the sheet substantially uniformly. In the method, the embossed pattern is formed from a number of flute portions oriented at an angle to each other and an intersection of these, the intersection and all the flute portions extending from it to a distance from the intersection being produced in a single embossing operation. In addition, the metal sheet is clamped from opposite sides in an area outside the embossed pattern and held in place so that the embossed pattern is mainly produced as a result of the sheet being stretched in the area of the embossed pattern, and the separately pressed embossed patterns are joined together in the areas of the flute portions.

11 Claims, 2 Drawing Sheets

SHEETMETAL FORMING METHOD

Figure 1:
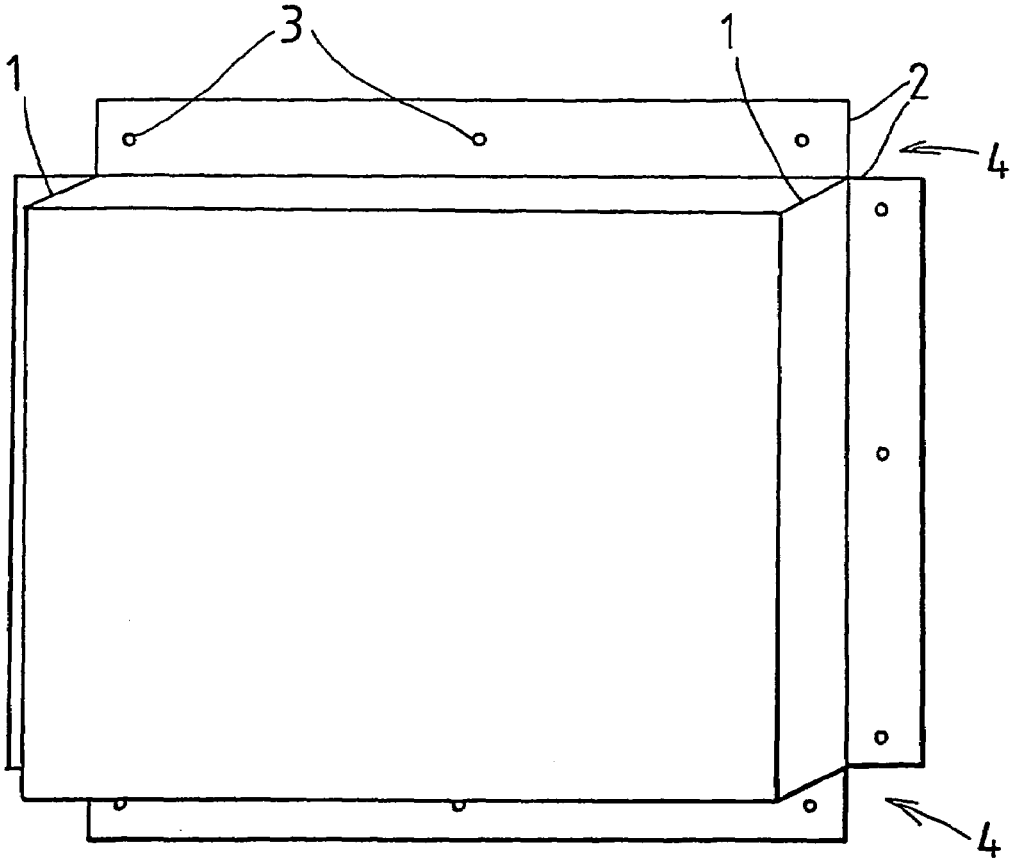

The present invention relates to a sheet metal forming method.

Thin sheetmetal (e.g. sheet steel 0.5–1.5 mm and sheet aluminum 1–4 mm) is widely used as a cladding material in buildings, both on exterior faces and interior structures. A traditional practice is to use a cassette structure in which metal sheets are cut and bent into the form of a cassette or box, and these are then screwed fast onto a studwork of steel or wood. The cassettes are mounted side by side and so that they partly overlap at their edges to form a cladding as impervious as possible, protecting the structures from rain and wind.

However, sheetmetal exterior claddings or cassettes used at present have significant drawbacks. To allow the cassette to be mounted in a watertight and neat-looking manner, the studwork structure supporting it has to be precisely straight. Each cassette has to be fitted, positioned and screwed fast separately, so the mounting process is slow and laborious.

At each corner point of the cassette, the cassette flanges mounted one upon the other do not completely cover the entire area because they are fastened in a point-by-point manner, which is why there always remain corner-point areas through which water may leak into the structure. This problem can be reduced by setting separate seaming strips on the joints as an extra operation.

The production costs of a cassette manufactured from sheetmetal are relatively high because both cutting and bending operations are needed and additionally the percentage of wasted raw material is significant due to the cutting. In the structure produced by cutting and bending, there always remain gaps at the corners, allowing water to leak into the structure. Moreover, the sheet edges at the corner points remain uncoated and thus largely susceptible to corrosion. Besides, the cassettes have a relatively monotonous and simple appearance, and therefore a wall surface made up of such cassettes is by no means elegant in an architectural sense.

In addition, due to the cuts and corner structures, at least some of the edges of the cassette have to be made perpendicular to the cassette surface, so adjacent cassettes will form slits of rectangular cross-section between them. Such slits are very unsatisfactory in long-time use because they accumulate impurities, which start running along the cassette surfaces before long, thus producing traces that foul the cassette wall structure and give it a disagreeable appearance. Therefore, traditional sheetmetal cassette wall structures would require relatively frequent washing to remain neat-looking, but as they are susceptible to water leakages, they do not readily tolerate washing. Besides, cleaning during use is not general practice.

Another traditional procedure is to produce profiled metal sheets with rounded or angular flutes by pressing a sheetmetal web between appropriately shaped rotating rollers. In this way, long fluted sheets are produced, and these are cut into desired lengths for use. This type of profiled sheets are widely used as wall cladding material in various warehouse buildings in both rural and industrial areas, but they are not elegant enough to be commonly used as cladding material on the exterior faces of e.g. public buildings and institutions, where cassette structures are generally used.

The object of the present invention is to overcome the drawbacks of prior art. A specific object of the invention is to disclose a new type of sheetmetal forming method that can be used to replace traditional sheetmetal cassette structures with more variform and varying sheetmetal claddings individually selected for and adapted to each application. A further object of the invention is to enable multidirectional and simultaneous forming of metal sheets.

In the sheetmetal forming method of the invention, to produce wall and ceiling cladding sheets from sheetmetal, embossed patterns are pressed into a metal sheet so that they cover the entire surface area of the sheet substantially uniformly. According to the invention, the embossed pattern is formed from a number of flute portions oriented at an angle to each other and an intersection of these, the intersection and all the flute portions extending from it to a distance from the intersection being produced in a single embossing operation. In addition, the metal sheet is clamped from opposite sides outside the embossed pattern and mainly held in place so that the embossed pattern is mainly produced as a result of the sheet being stretched in the area of the embossed pattern. The embossed pattern to be formed may have a depth of the order of up to 50 times the thickness of the blank.

Next, these embossed patterns arranged in a radial configuration and separately pressed are joined together in the areas of the flute portions, in other words, they are pressed into the metal sheet in such manner that the flute portions of adjacent embossed patterns overlap each other to a sufficient degree so as to form continuous flutes between the intersections of adjacent embossed patterns. In this way, the embossed patterns consisting of the intersection and the flute portions starting from it form in the metal sheet a network of flutes, a continuous and repeated pattern consisting of flute intersections and flute portions connecting the intersections.

In an embodiment of the invention, the metal sheet is held clamped in the area just immediately around the embossed pattern so that the embossed pattern is practically formed by only stretching the sheet in the area of the embossed pattern. Another possibility, depending on the embossed pattern to be produced, is to hold the sheet clamped in an area inside the pattern as well.

In another embodiment of the invention, clamping is only applied to the edge areas of the metal sheet to be formed. Thus, the whole sheet can be clamped down at its edges, whereupon it is possible to form embossed patterns in the sheet according to the invention so that an entire sheet patterned in a desired manner is obtained.

Pressing the metal sheet and holding it in place preferably means that the pressing device has e.g. a lower tool and an upper tool which have a shape corresponding to the desired shapes of the metal sheet and between which the metal sheet is placed and stretched to form embossed patterns. At the same time, those portions or areas of the metal sheet that are close to the embossed pattern or only the edge areas of the sheet are clamped between an upper and a lower part of a holding tool while the embossing process is going on, so that the metal sheet is practically only stretched in the area of the embossed pattern and above all remains straight and uncreased during the forming.

The method of the invention uses a continuous, practically endless blank taken from a coil or roll, and the blank is pressed and formed in stages. Such a production process is very flexible and allows both small and large series to be advantageously produced.

A sheet may preferably have two or more embossed patterns connected by flute portions to form a larger embossed pattern that comprises several intersections and is produced by a single embossing operation, which significantly accelerates the forming of the metal sheet. The embossed pattern produced by a single embossing operation may preferably have a width covering the entire metal sheet, e.g. 1250 mm.

The lengths of the flute portions in the embossed patterns may vary or they can preferably be variable in such manner that the distance between embossed patterns or their intersections can be adjusted as desirable in different applications. In this way, a checkered pattern of desired size can be formed in the metal sheet e.g. completely steplessly. Thus, in a preferred embodiment of the invention, the flute portions are at right angles to each other and each embossed pattern has flute portions extending in four directions from the intersection, so when these patterns are embossed and the flute portions of adjacent embossed patterns merge, rectangular or maybe square fluting is formed in the metal sheet.

In a preferred embodiment of the invention, the intersection of the embossed pattern does not only consist of a junction between flute portions; instead, an embossed area wider or larger than the flutes, e.g. a circular or square area is formed, the flute portions merging with the intersection at its edges. In this way, a more vivid and more variform embossed pattern is produced.

Thus, an essential feature of the sheetmetal forming method of the invention is that a given repeating embossed pattern is produced by a stepwise embossing process, i.e. by forming one embossed pattern at a time, so that the embossed patterns in a completed sheet cover substantially the entire sheet area either as a continuous network or as separate and adjacent patterns. A further essential feature is that sheet portions near the embossed pattern or at a distance from it are clamped and held in place during the embossing process so that the embossed patterns are mainly or substantially formed by stretching the sheet in the area of the embossed patterns only, thus allowing the sheet to remain straight and the patterns to be accurately aligned with each other in spite of the stepwise nature of the embossing process.

As compared with prior art, the sheetmetal forming method of the invention has significant advantages. By this method, it is possible to produce large and continuous patterned sheetmetal surfaces, which means that the number of seams and joining areas is reduced and the sheets can be mounted significantly faster and more easily. By using stamping, painting or another embossing technique, it is possible to give the complex of patterns thus formed a decorative appearance, e.g. imitating different facings, such as cleft-face stone or logos. Moreover, unlike prior art solutions, the sheet can be mounted with either the relief surface or the recessed surface facing towards the observer.

In addition, the structure is very watertight because no cuts are needed and all edges of the sheets remain straight, with the result that no leakage points or exposed leakage points susceptible to corrosion are formed even at the corners of the joints. As compared with traditional cassettes, the edges of different parts are tightened by virtue of their shapes and the sheets being mounted with their edges partly overlapping each other with a tight fit.

Significant advantages are achieved in respect of manufacturing costs because practically no cutting is needed but only stepwise pressing to shape and a ready-made sheet in desired size is obtained; the width is at most the width of the raw material web, and the length can be almost freely defined.

The flutes used can be formed in suitable symmetric or unsymmetric, beveled or rounded shapes so that they will not gather impurities and foul the whole structure as state-of-the-art cassettes do. Due to the large sheets and their rigid structure, the mountings are not required to be as accurately dimensioned as in prior art. Further, the panel sizes of the shapes, such as checkers, formed in the metal sheet can be freely chosen, which significantly facilitates the task of mounting the sheets as the sheets can be sized beforehand in accordance with the dimensions of the mount so that no cutting or severing is needed on the installation site.

In addition, besides straight surfaces, the invention also makes it possible to create very tight, precise and accurately dimensioned cladding structures for curved surfaces e.g. in various containers, tank towers and stairwells. Further, due to their possible large size and high rigidity, products manufactured by the method of the invention can also be used as cladding e.g. on ceilings and noise barriers. Thanks to the rigid structure, the cladding does not produce any clang or noise in windy conditions as traditional cassette structures do.

Figure 2:
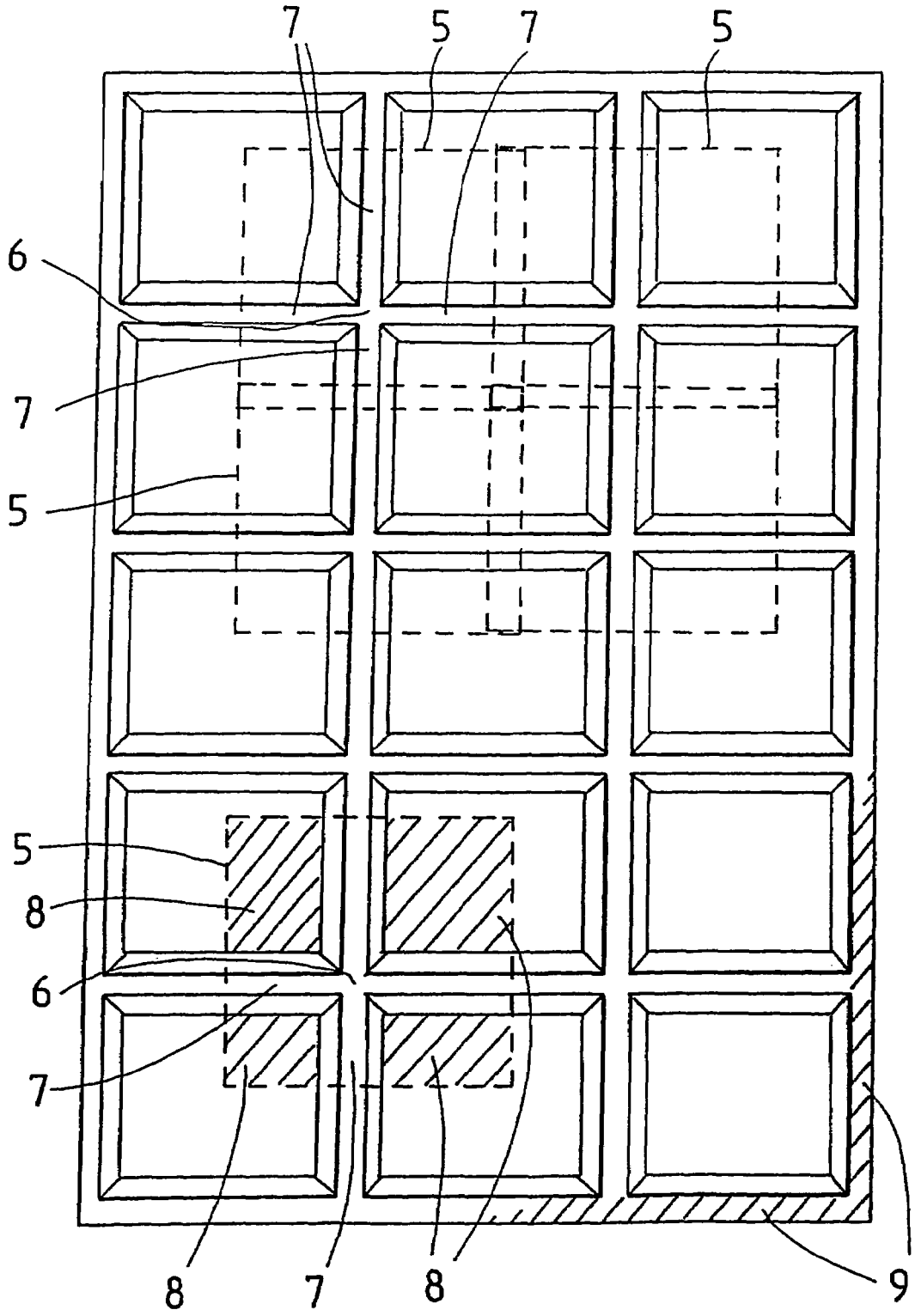

In the following, the invention will be described in detail with reference to the attached drawings, wherein FIG. 1 presents a prior-art cassette structure, and FIG. 2 presents a metal sheet produced by the method of the invention.

FIG. 1 presents a prior-art standard cassette type widely used at present. The cassette is made by cutting and bending a metal sheet. In addition to being slow and laborious to produce, the cassette has corrosion-prone cut corners 1 and holes 3. In addition, the open corners land exposed corner areas 4 constitute bad leakage points in the structure. Cassette sizes generally vary between 300×400 and 1000×2000 mm, so when small cassettes are used, the cost of installation work is a significant proportion of total costs.

FIG. 2 presents a metal sheet produced by the method of the invention. The raw material used is e.g. a sheetmetal band which may have a width of 200 . . . 1500 mm in the widthways direction of the figure and an almost endless length in the vertical direction of the figure. According to the invention, each embossed pattern 5 consists of an intersection 6 and four flute portions 7 starting from it at an angle of 90° to each other.

The size of the embossed pattern 5 is such that two adjacent embossed patterns pressed at separate times clearly overlap each other. This ensures that the flute portions of two adjacent embossed patterns will precisely merge into a single continuous flute portion connecting two intersections. In this embodiment, the flute portions have the form of an equilateral trapezoid, but they may have varying forms, being almost rectangular, round, round-cornered or suitable combinations of these.

In the lower part of FIG. 2 is depicted an individual rectangular embossed pattern 5, in which the slashed areas 8 represent the areas where the metal sheet is held fast and clamped by means of a suitable holding tool while the flute portions and the intersection are being pressed and formed between these areas 8. Another possibility is to clamp the sheet and hold it in place by applying a clamping force to its edge areas 9 only.

The result obtained in this embodiment is a single and continuous formed sheetmetal product of desired length that corresponds to a plurality of traditional separate cassettes. It can be fastened using only a few screws. It has no corrosion-prone cuts except for the outer edges. It comprises very few seams, thus minimizing potential leakage points.

In the foregoing, the invention has been described by way of example with reference to the attached drawings while different embodiments of the invention are possible in the scope defined in the claims.

The invention claimed is:

1. Forming method for producing wall and ceiling cladding sheets from sheetmetal, wherein embossed patterns are pressed into a metal sheet so that they cover the entire surface area of the sheet substantially uniformly, wherein a first embossed pattern is formed from four flute portions oriented at right angles to each other and an intersection of the flute portions, the intersection and all the flute portions extending from it to a distance from the intersection being produced in a single embossing operation, the metal sheet is clamped from opposite sides in an area outside the embossed pattern and held in place so that the embossed pattern is produced as a result of the sheet being stretched in the area of the embossed pattern, and separately pressed adjacent embossed patterns are joined together with the first embossed pattern in overlapping areas of the flute portions, and a length of the overlapping flute portions are adjusted to adjust a distance between the first embossed pattern and the adjacent embossed patterns and a distance between the intersections of the flute portions of the first embossed pattern and the adjacent embossed patterns.

2. Forming method according to claim 1, wherein a flute network consisting of flute intersections and flute portions connecting the intersections is formed in the metal sheet from the embossed patterns consisting of an intersection and flute portions starting from it.

3. Forming method according to claim 1, wherein two embossed patterns connected by a common flute portion are pressed simultaneously.

4. Forming method according to claim 1, wherein a number of embossed patterns connected by flute portions are pressed simultaneously.

5. Forming method according to claim 1, wherein the flute portions are at right angles to each other in the embossed pattern so that a rectangular, fluting is pressed into the metal sheet.

6. Forming method according to claim 5, wherein the rectangular fluting is square shaped.

7. Forming method according to claim 1, wherein only straight flute portions are used.

8. Forming method according to claim 1, wherein an area wider than the flutes is formed at the intersection.

9. Forming method according to claim 1, wherein the metal sheet is held clamped in the areas immediately around the embossed pattern so that the embossed pattern is practically formed by the sheet being stretched in the area of the embossed pattern only.

10. Forming method according to claim 1, wherein the metal sheet is held clamped in the edge areas of the entire metal sheet to be formed.

11. Forming method according to claim 8, wherein a rectangular shaped area wider than the flutes is formed at the intersection.

* * * * *